US005758230A

United States Patent [19]

Nakaue et al.

[11] Patent Number: 5,758,230

[45] Date of Patent: May 26, 1998

[54] DEVICE FOR DEVELOPING ELECTROSTATIC LATENT IMAGE

[75] Inventors: Takahisa Nakaue; Masanobu Maeshima; Akinobu Nakahata; Takeshi Aoki; Hiroshi Inui; Naoyuki Ishida, all of Osaka, Japan

[73] Assignee: Mita Industrial Co., Ltd., Osaka, Japan

[21] Appl. No.: 740,076

[22] Filed: Oct. 24, 1996

[30] Foreign Application Priority Data

| | | | |
|---|---|---|---|
| Nov. 10, 1995 | [JP] | Japan | 7-317190 |
| Nov. 10, 1995 | [JP] | Japan | 7-317191 |
| Nov. 10, 1995 | [JP] | Japan | 7-317193 |

[51] Int. Cl.[6] ..... G03G 15/08

[52] U.S. Cl. ..... 399/103; 399/98

[58] Field of Search ..... 399/98, 102, 103, 399/105; 222/DIG. 1

[56] References Cited

U.S. PATENT DOCUMENTS

| | | | |
|---|---|---|---|
| 4,616,919 | 10/1986 | Adley et al. | 399/103 |
| 5,073,797 | 12/1991 | Ono et al. | 399/105 |
| 5,585,895 | 12/1996 | Yashiro et al. | 399/103 |

FOREIGN PATENT DOCUMENTS

| | | |
|---|---|---|
| 3-73980 | 3/1991 | Japan . |
| 4-322273 | 11/1992 | Japan . |
| 4-355778 | 12/1992 | Japan . |

*Primary Examiner*—Arthur T. Grimley
*Assistant Examiner*—Quana Grainger
*Attorney, Agent, or Firm*—Beveridge, DeGrandi, Weilacher, Young, LLP

[57] ABSTRACT

A device for developing an electrostatic latent image that includes a developing roller which is disposed in a developing housing, holds the developing agent on its peripheral surface, and conveys the developing agent that is held to a developing zone, a feeding roller for feeding the developing agent onto the peripheral surface of the developing roller, and seals that are disposed so as to be opposed to both ends of the developing roller from the downstream side of the developing zone to the upstream side of a developing agent-limiting zone. The device further includes seal lips that are formed in a protruding manner and which extend from one end on the side of the developing zone to an opposite end on the side of the developing agent-limiting zone. The feeding or replenishing roller is positioned so that its end surfaces are in contact with the inner end surfaces of the seals.

11 Claims, 9 Drawing Sheets

DEVICE FOR DEVELOPING ELECTROSTATIC LATENT IMAGE

FIELD OF THE INVENTION

The present invention relates to a device for developing an electrostatic latent image for use in developing a toner image in an image-forming machine such as electrostatic copying machine or laser printer.

DESCRIPTION OF THE PRIOR ART

There has been widely used a device for developing an electrostatic latent image of the type in which the electrostatic latent image in an image-forming machine is developed into a toner image using a developing agent consisting of a one-component toner. The device for developing electrostatic latent image of this type comprises a developing housing having a developing chamber and a stirrer chamber, as well as a developing roller disposed in the developing chamber to hold, on the peripheral surface thereof, a developing agent in a developing agent-holding zone. The developing roller conveys the thus held developing agent to a developing zone to apply it to the electrostatic latent image and a replenishing roller is disposed in the developing chamber to serve as a feeding means for feeding the developing agent onto the peripheral surface of the developing roller in the developing agent-holding zone. The device further includes a stirring means disposed in the stirrer chamber to stir the developing agent that is fed through a developing agent-feeding port and send the stirred developing agent to the developing chamber. A limiting means acts on the peripheral surface of the developing roller and limits the amount of the developing agent held on the surface in a developing agent-limiting zone located between the developing agent-holding zone and the developing zone. In order to prevent the developing agent from infiltrating into the bearings that support the rotary shaft of the developing roller, furthermore, a seal is provided that extends from the downstream side of the developing zone (i.e., from the downstream side of a portion where the developing roller comes into contact with the photosensitive material) to the upstream side of the developing agent-limiting zone. The seal comes into contact with the peripheral surfaces of both end portions of the developing roller. Also, a portion of the developing housing, that corresponds to the developing zone, is opened.

The seals are provided with seal lips that tilt inwardly from one end on the side of the developing zone toward an opposite end on the side of the developing agent-limiting zone. The developing agent that falls on the inside of the seal lips is guided by the seal lips with the rotation of the developing roller and is conveyed toward the end on the side of the developing agent-limiting zone. However, the developing agent that is conveyed toward the end on the side of the developing agent-limiting zone while being guided by the seal lips tends to stay at the end on the side of the developing agent-limiting zone, and adheres in the form of vertical stripes on the peripheral surface of the developing roller. As a result, vertical stripes appear on the image.

The seals have protruding seal lips that extend from one end on the side of the developing zone to an opposite end on the side of the developing agent-limiting zone. Therefore, the developing agent that has infiltrated into space on the outside of the seal lips of the seals at the end on the side of the developing agent-limiting zone scatters and adheres on the bearings of the developing roller to cause bearing malfunctions. Besides, the developing agent scatters from the end on the side of the developing zone.

In the device for developing electrostatic latent image of the type which develops toner image using the developing agent composed of a one component toner, furthermore, the developing agent tends to adhere also on the areas other than the image-forming area, since the developing agent is held on the peripheral surface by applying a predetermined voltage to the developing roller. In order to prevent the developing agent from infiltrating into the bearings that support the rotary shaft of the developing roller, seals are provided that extend from the downstream side of the developing zone (i.e., from the downstream side of a portion where the developing roller comes into contact with the photosensitive material) to the upstream side of the developing agent-limiting zone. The seals are also arranged so as to come into contact with the peripheral surfaces of both end portions of the developing roller. There, however, remains a problem in that the developing agent adhered to the areas other than the image-forming area stays in the sealing portion and scatters through the opening on the side of the developing zone in the developing housing.

SUMMARY OF THE INVENTION

A first object of the present invention is to provide a device for developing an electrostatic latent image which is capable of preventing the developing agent from staying at the end on the side of the developing agent-limiting zone. This is achieved by causing the end surfaces of the replenishing roller to act on the developing agent that is conveyed toward the end on the side of the developing agent-limiting zone while being guided by seal lips with the rotation of the developing roller, so that part of the developing agent that is conveyed adheres to the replenishing roller, and by pulverizing the developing agent when it starts to solidify.

A second object of the present invention is to provide a device for developing an electrostatic latent image which is capable of preventing the scattering of developing agent by inhibiting the developing agent from infiltrating into the space located on the outside of the seal lips of the seals that are disposed so as to be opposed to both ends of the developing roller.

A third object of the present invention is to provide a device for developing an electrostatic latent image which is capable of preventing the developing agent from scattering through the opening on the side of the developing zone in the developing housing.

In order to accomplish the above-mentioned first object according to the present invention, there is provided a device for developing an electrostatic latent image that includes a developing housing and a developing roller which is disposed in the developing housing, holds the developing agent on the peripheral surface thereof in a developing agent-holding zone, and conveys the developing agent that is held to a developing zone to apply it to electrostatic latent image. The device also includes a feeding roller for feeding the developing agent onto the peripheral surface of the developing roller in the developing agent-holding zone, and seals that are disposed so as to be opposed to both ends of the developing roller from the downstream side of the developing zone to the upstream side of a developing agent-limiting zone. The seals have protruding seal lips that extend from one end on the side of the developing zone to an opposite end on the side of the developing agent-limiting zone. The seal lips of the seals are formed so as to tilt while extending from the outer end on the side of the developing zone to the inner end on the side of the developing agent-holding zone, and the replenishing roller is so positioned that the end surfaces thereof are in contact with the inner end surfaces of the seals.

In order to accomplish the above-mentioned second object according to the present invention, there is provided a device for developing an electrostatic latent image that includes a developing housing, and a developing roller which is disposed in the developing housing, holds the developing agent on the peripheral surface thereof in a developing agent-holding zone, and conveys the developing agent that is held to a developing zone to apply it to electrostatic latent image. There is also provided a developing agent-limiting means equipped with a blade for limiting the amount of the developing agent held on the peripheral surface of the developing roller in a developing agent-limiting zone between the developing agent-holding zone and the developing zone. The device also features seals that are disposed so as to be opposed to both ends of the developing roller from the downstream side of the developing zone to the upstream side of the developing agent-limiting zone and which have seal lips formed in a protruding manner from the end on the side of the developing zone to the end on the side of the developing agent-limiting zone. The lower end of the blade, constituting the developing agent-limiting means, is positioned in contact with the end surfaces of the seals.

In order to accomplish the above-mentioned third object according to the present invention, there is provided a device for developing an electrostatic latent image that includes a developing housing and a developing roller which is disposed in the developing housing, holds the developing agent on the peripheral surface thereof in a developing agent-holding zone, and conveys the developing agent that is held to a developing zone to apply it to electrostatic latent image. There is also provided a developing agent-limiting means for limiting the amount of the developing agent held on the peripheral surface of the developing roller in a developing agent-limiting zone between the developing agent-holding zone and the developing zone. The device also features seals that are disposed so as to be opposed to both ends of the developing roller from the downstream side of the developing zone to the upstream side of the developing agent-limiting zone and which have seal lips formed in a protruding manner that extend from one end on the side of the developing zone to an opposite end on the side of the developing agent-limiting zone. The device further includes a sheet-like sealing member made of an elastic material that is positioned so that one end is fitted into an open end on the side of the developing zone on the bottom wall of the developing housing, while its other end is brought into contact with the peripheral surface of the developing roller, and its both ends in the direction of width are brought into contact with the inner side surfaces of the seal lips.

In order to accomplish the above-mentioned third object according to the present invention, furthermore, there is provided a device for developing an electrostatic latent image that includes a developing housing, a developing roller which is disposed in the developing housing, holds the developing agent on the peripheral surface thereof in a developing agent-holding zone, and conveys the developing agent that is held to a developing zone to apply it to electrostatic latent image. There is also provided a developing agent-limiting means for limiting the amount of the developing agent held on the peripheral surface of the developing roller in a developing agent-limiting zone between the developing agent-holding zone and the developing zone. The device also features seals that are disposed so as to be opposed to both ends of the developing roller from the downstream side of the developing zone to the upstream side of the developing agent-limiting zone and which have seal lips formed in a protruding manner and which extend from one end on the side of the developing zone to an opposite end on the side of the developing agent-limiting zone. The device further comprises a sheet-like sealing member made of an elastic material positioned so that one end is fitted into an open end on the side of the developing zone on the bottom wall of the developing housing, its other end is brought into contact with the peripheral surface of the developing roller, and both of its ends in the direction of width are located on the seal lips.

In order to accomplish the above-mentioned third object according to the present invention, furthermore, there is provided a device for developing an electrostatic latent image that includes a developing housing and a developing roller which is disposed in the developing housing, holds the developing agent on the peripheral surface thereof in a developing agent-holding zone, and conveys the developing agent that is held to a developing zone to apply it to electrostatic latent image. There is also provided a developing agent-limiting means for limiting the amount of the developing agent held on the peripheral surface of the developing roller in a developing agent-limiting zone between the developing agent-holding zone and the developing zone. The device also features seals that are disposed so as to be opposed to both ends of the developing roller from the downstream side of the developing zone to the upstream side of the developing agent-limiting zone and which have seal lips formed in a protruding manner which extend from one end on the side of the developing zone to an opposite end on the side of the developing agent-limiting zone. The device further comprises a sheet-like sealing member positioned so that one end is fitted into an open end on the side of the developing zone on the bottom wall of the developing housing and its other end is brought into contact with the developing roller. A sheet-like cover member is also provided and is positioned so that one end is fitted into an open end on the side of the developing zone on the bottom wall of the developing housing and its other end is located so as to maintain a small gap relative to the peripheral surface of the developing roller.

DETAILED DESCRIPTION OF THE PREFERRED EMBODIMENTS

A preferred embodiment of the device of the present invention for developing an electrostatic latent image will now be described in further detail with reference to the accompanying drawings.

Figure 1:
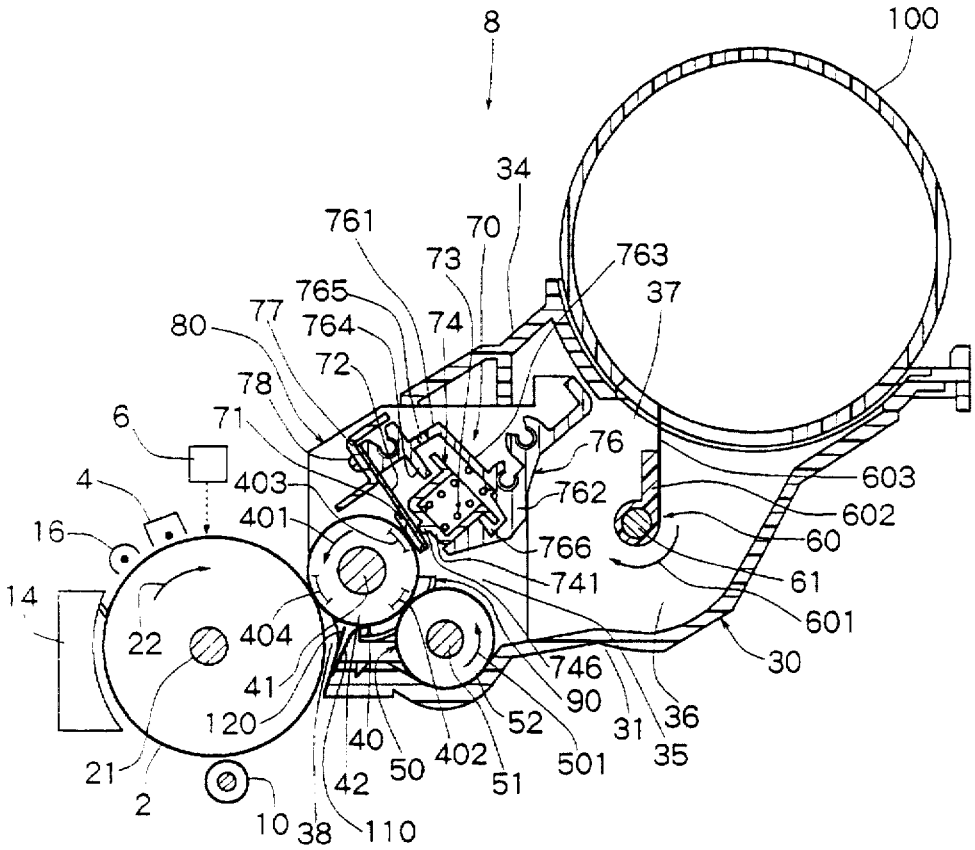
FIG. 1 is a sectional view schematically illustrating the constitution of an image-forming machine equipped with a device for developing electrostatic latent image constituted according to an embodiment of the present invention.

FIG. 1 illustrates an image-forming machine equipped with the device of the present invention for developing an electrostatic latent image. The illustrated image-forming machine is equipped with a rotary drum 2 having, arranged on the peripheral surface thereof, an electrostatic photosensitive material that serves as an image carrier. The rotary drum 2 is mounted by means of a rotary shaft 21 in a machine housing that is not shown, and is allowed to freely rotate. Around the rotary drum 2 that rotates in a direction of an arrow 22, there are arranged a corona discharger 4 for charging the photosensitive layer of the rotary drum 2 to a particular polarity, a laser optical device 6 which is an exposure means for forming an electrostatic latent image on the photosensitive layer of the rotary drum 2 charged to the particular polarity by the corona discharger, a device 8 for developing an electrostatic latent image formed by a laser beam irradiated from the optical device 6 into a toner image, a transfer roller 10, a cleaning device 14 and a charge-removing lamp 16, as viewed in a direction of rotation.

The device 8 for developing an electrostatic latent image is equipped with a developing housing 30 that can be formed of a synthetic resin. In the developing housing 30 are arranged a developing roller 40, a replenishing roller 50, a stirring means 60 and a developing agent-limiting means 70. On the developing housing 30 is mounted a toner cartridge 100 as a developing agent container.

Figure 2:
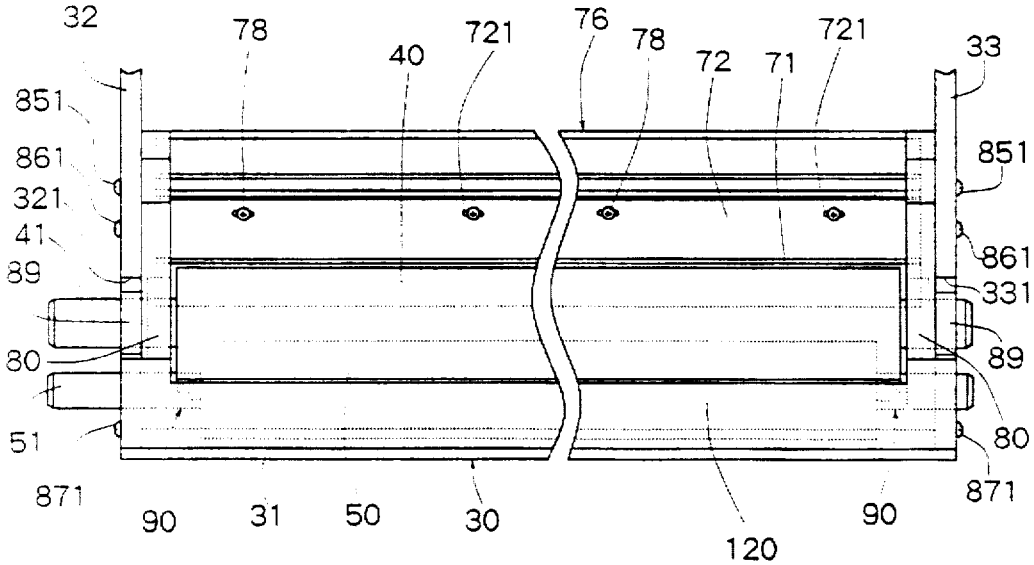
FIG. 2 is a side view illustrating major portions of the device for developing an electrostatic latent image shown in FIG. 1.

The developing housing 30 is formed of a synthetic resin, and is constituted by a bottom wall 31, both side walls 32 and 33 (see FIG. 2) and an upper wall 34, and has a developing chamber 35 and a stirrer chamber 36. The developing housing 30 is further provided with an opening 37 formed between the bottom wall 31 and the upper wall 34 at a right upper end in FIG. 1. A toner cartridge 100 is mounted on the opening 37. Moreover, an opening 38 is formed at a left of the developing housing 30, i.e., at the end on the side of the developing zone that is opposed to the rotary drum 2.

The developing roller 40 is disposed in the developing chamber 35 in the developing housing 30, and includes a rotary shaft 41 that is rotatably supported between both side walls (not shown) of the developing housing 30 and a solid synthetic rubber roller 42 fitted to the outer peripheral surface of the rotary shaft 41. The rotary shaft 41 can be made of a suitable metal material such as stainless steel. The solid synthetic rubber roller 42 is constituted by a relatively soft material having electrically conducting property or an electrically conducting solid synthetic rubber such as urethane rubber. In the illustrated embodiment, the peripheral surface of the solid synthetic rubber roller 42 has a roughness i.e., a ten-point average roughness Rz as stipulated under JIS B 0601 of 5.0 to 12.0. The solid synthetic rubber roller 42 has a volume resistivity of from about $10^6$ to about $10^9$ Ωcm. In the developing roller 40 constituted by the rotary shaft 41 made of a metal material and the solid synthetic rubber roller 42 fitted to the outer peripheral surface of the rotary shaft 41, the rotary shaft 41 has an outer diameter of, for example, 8 to 10 mm and the solid synthetic rubber roller 42 has an outer diameter of, for example, 16 mm. When the rotary shaft 41 has an outer diameter of 8 mm, therefore, the solid synthetic rubber roller 42 has a thickness of 4 mm in the radial direction and when the rotary shaft 41 has an outer diameter of 10 mm, the solid synthetic rubber roller 42 has a thickness of 3 mm in the radial direction. When a rubber that constitutes the solid synthetic rubber roller 42 has the same hardness, the hardness of the developing roller as an assembly varies. That is, the hardness of the developing roller using the rotary shaft of an outer diameter of 8 mm becomes smaller than that of the developing roller using the rotary shaft of an outer diameter of 10 mm. In the illustrated embodiment, the developing roller, as an assembly, constituted by the rotary shaft 41 and the solid synthetic rubber roller 42 fitted to the outer peripheral surface of the rotary shaft 41 has a hardness of from 60 to 80 in terms of Asker's C hardness. The roller 42 of the thus constituted developing roller 40 is exposed through the opening formed in the developing housing 30 and is positioned being opposed to the rotary drum 2. The peripheral surface of the roller 42 constituting the developing roller 40 is brought into pressed contact with the peripheral surface of the rotary drum 2, and is elastically compressed to some extent in the press-contacted region. The rotary shaft 41 of the developing roller 40 is continuously rotated by a drive means that is not shown in a direction indicated by an arrow 401 in FIG. 1. With the rotation of the rotary shaft 41, the roller 42 is also continuously rotated in the direction indicated by the arrow 401, and the peripheral surface of the roller 42 passes through a developing agent-holding zone 402, developing agent-limiting zone 403 and developing zone 404, successively. In the illustrated embodiment, a constant voltage of 300 V is applied to the rotary shaft 41 of the developing roller 40. The rotary shaft 41 of the developing roller 40 is supported at its both ends by bearing support members 80 and 80 so as to rotate, and is mounted together with the developing agent-limiting means 70 that will be described later, as a unitary structure in the developing housing 30. The developing roller 40, developing agent-limiting means 70 and bearing support members 80, 80 that are constructed as a unitary structure will be described later in detail.

The replenishing roller 50 is disposed, in parallel with the developing roller 40, in the developing chamber 32 in the developing housing 30 and includes a rotary shaft 51 rotatably supported between both side walls 32 and 33 of the developing housing 30 and a roller 52 fitted to the outer peripheral surface of the rotary shaft 51. Like the rotary shaft 41 of the developing roller 40, the rotary shaft 51 can be made of a suitable metal material such as stainless steel. The roller 52 is constituted by a foamed material such as foamed silicon or foamed urethane. The roller 52 is brought into pressed contact with the roller 42 of the developing roller 40. The foamed material constituting the roller 52 has a hardness (e.g., Asker's C hardness of about 35) which is considerably smaller than that of the roller 42 of the developing roller 40. It is desired that the roller 52 that is brought into pressed contact with the roller 42 of the developing roller 40 is elastically compressed by about 0.1 to 0.6 mm in the press-contacted region. The roller 52, too, has electrically conducting property, and has a volume resistivity of from about $10^6$ to about $10^9$ Ωcm. The roller is continuously rotated by a drive means that is not shown in a direction indicated by an arrow 501 in FIG. 1. In the illustrated embodiment, the rotary shaft 51 of the replenishing roller 50 is impressed with a constant voltage of 450 V which is higher than the voltage applied to the developing roller 40.

The stirring means 60 is disposed in the stirrer chamber 36 of the developing housing 30 in parallel with the replenishing roller 52, and includes a rotary shaft 61 rotatably supported between both side walls (not shown) of the developing housing 30, a stirrer member 602 fitted to the rotary shaft 61, and a resilient stirrer sheet member 603 mounted on the stirrer member 602. The stirrer member 602 is made of a synthetic resin and has a plurality of openings in the direction of width thereof. The stirrer sheet member 603 is made of, for example, a polyethylene terephthalate (PETP) resin and has, at its one end portion, an opening that corresponds to the opening formed in the stirrer member 602, and is fastened to the stirrer member 602 by an adhesive. The other end of the stirrer sheet member 603 protrudes beyond the stirrer member 602. The thus constituted stirring means 60 is continuously rotated by a drive means that is not shown in a direction indicated by an arrow 601 in FIG. 1.

The developing agent-limiting means 70 comprises a flexible blade 71 brought into pressed contact with the peripheral surface of the roller 42 which constitutes the developing roller 40, a flexible support plate 72 constituting a support means of the blade 71, a resilient urging means 73 that pushes one surface of the blade 71 toward a direction to come into contact with the peripheral surface of the roller 42, and a support holder 76 for supporting the blade 71, support plate 72 and resilient urging means 73.

The support holder 76 is formed by, for example, extrusion-molding an aluminum alloy. The support holder 76 has a length in the direction of width which corresponds to a distance between both its side walls 32, 33 of the developing housing 30, and comprises an upper wall 761 for mounting the upper end of the support plate 72, a lower wall 762 formed at a predetermined distance from the upper wall 761, and a rear wall 763 that connects the upper wall 761 to the rear end of the lower wall 762. In the intermediate portion of the upper wall 761 is provided a guide rail 764 that protrudes inwardly and extends in the direction of the whole width, and a plurality of pin-insertion holes (three holes in the illustrated embodiment) 765 are formed between the guide rail 764 of the upper wall 761 and the rear wall 763. In the lower wall 762 is formed a guide groove 766 at a position that faces the guide rail 764, the guide groove 766 extending in the direction of the whole width. A plurality of threaded holes 767 (five holes in the illustrated embodiment) (see FIG. 3) are formed in the front end surface of the upper wall 761. The thus constituted support holder 76 holds a blade 71, a support plate 72 and a resilient urging means 73 in a manner as will be described later to constitute the developing agent-limiting means 70, and is mounted together with the developing roller 40 as a unitary structure in the developing housing 30. The developing roller 40 and the developing agent-limiting means 70 constructed as a unitary structure will be described later in detail.

The flexible blade 71 has a length in the direction of width which corresponds to the length of the roller 42 that constitutes the developing roller 40, and has at least one surface thereof (surface brought into pressed contact with the peripheral surface of the roller 42 constituting the developing roller 40) constituted by a flat plate-like member that extends in the direction of width (direction perpendicular to the surface of the paper in FIG. 1) along the peripheral surface of the roller 42. It is desired that at least the region of one surface of the blade 71 brought into pressed contact with the peripheral surface of the roller 42 has a sufficiently small surface roughness and a ten-point average roughness Rz stipulated under JIS B 0601 of from 5.0 to 12.0. As the surface roughness on one surface of the blade becomes too great, the surface of the toner layer formed on the peripheral surface of the roller 42 that constitutes the developing roller 40 is not flattened to a sufficient degree and is liable to be nonuniform. A sheet glass placed in the market can be exemplified as a suitable material that can be used as the blade 71 relatively cheaply yet exhibiting a sufficiently small roughness, a high hardness and a large abrasion resistance. The sheet glass having a thickness of about 0.5 to 2.0 mm can be used. According to experiment conducted by the present inventors, it was found that the sheet glass constituting the blade 71 having a thickness not larger than 0.5 mm is likely to be cracked during the operation, and the sheet glass having a thickness of not smaller than 2.0 mm makes it difficult to obtain a predetermined flexibility. When it is desired to apply a required voltage to the blade 71 to control the charging property of the toner, an electrically conducting film may be applied to one surface of the sheet glass. The blade 71 can also be constituted by using a suitable flexible metal plate such as of a stainless steel in place of using the sheet glass. To sufficiently decrease the surface roughness on one surface of the metal plate constituting the blade 71, a suitable surface treatment may be effected for one surface of the metal plate, as required.

Figure 3:
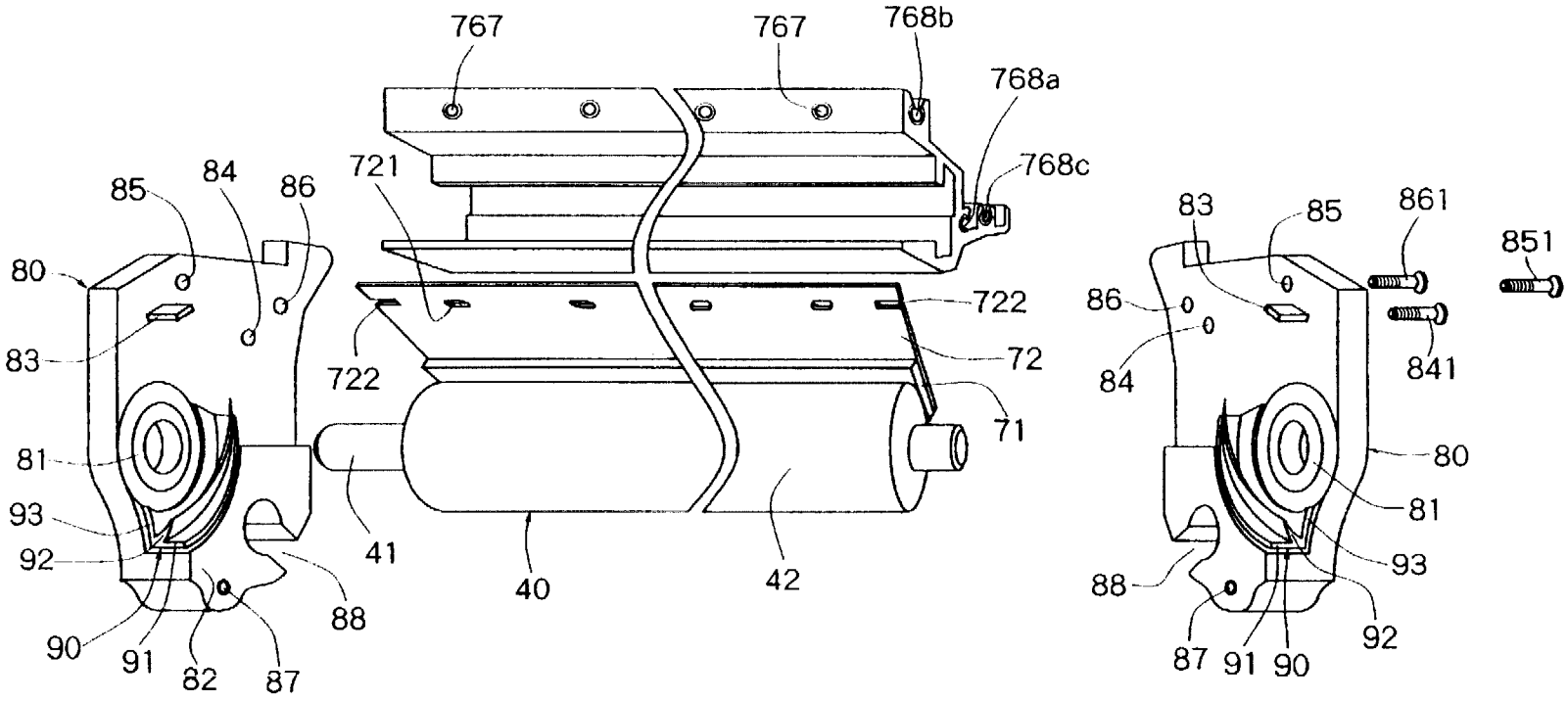
FIG. 3 is a perspective view illustrating, in a disassembled manner, a developing roller, a developing agent-limiting means and a bearing-support member mounted on the device for developing an electrostatic latent image shown in FIG. 1.

In the illustrated embodiment, the support plate 72 is constituted by a plate spring member such as thin spring steel plate or thin stainless steel plate, and has a length in the direction of width nearly the same as that of the blade 71. The support plate 72 must have flexibility and, hence, it is desired to use a steel plate having a thickness of about 0.1 mm. As shown in FIG. 3, the support plate 72 has a plurality of oval holes 721 (five holes in the illustrated embodiment) formed in the upper end portion thereof at a predetermined distance in the direction of width. The oval holes 721 are corresponding to the plurality of threaded holes 767 (five holes in the illustrated embodiment) formed in the front end surface of the upper wall 761 of the support holder 76. Furthermore, positioning notches 722 and 722 serving as positioning means are formed at both upper side ends of the support plate 72. The thus constituted support- plate 72 is fastened at the surface of the lower end thereof to the other surface of the blade 71 by a fastening means such as adhesive agent. When it is desired to apply a required voltage to the blade 71 to control the charging property of the toner, an electrically conducting adhesive is used as the fastening means thereby to allow to apply the required voltage to the blade 71 through the support plate 72. As described above, the support plate 72 fastened at its upper end to the other surface of the blade 71 is fastened and supported by using screws 78 that are screwed in the threaded holes 767 formed in the front end surface of the upper wall 761 constituting the support holder 76, via a patch 77 and -he holes 721.

The pushing member 74 has a length in the direction of the width which is nearly the same as that of the blade 71 and has the shape of a hat in cross section of which the rear end is opened, and is constituted by a front wall 741 opposed to the support plate 72, an upper wall 742, a lower wall 743, and guide support portions 744 and 745 that extend upwards and downwards from the rear ends of the upper wall 742 and the lower wall 743, respectively. A protrusion (elongated protrusion) 746 is formed on the front surface of the front wall 741 to constitute a pushing portion at an intermediate portion in the up-and-down direction over the whole width. Between the upper wall 742 and the lower wall 743, furthermore, there are formed a plurality of spring-fitting chambers 749 (six chambers in the illustrated embodiment) by partitioning walls 747 and 748 formed at an equal distance in the direction of width, and a compression coil spring 731 that constitutes the resilient urging means 73 is fitted in each of the chambers. The thus constituted pushing member 74 is molded as a unitary structure using, for example, a synthetic resin. It is important that the pushing member 74 has flexibility.

Figure 7:
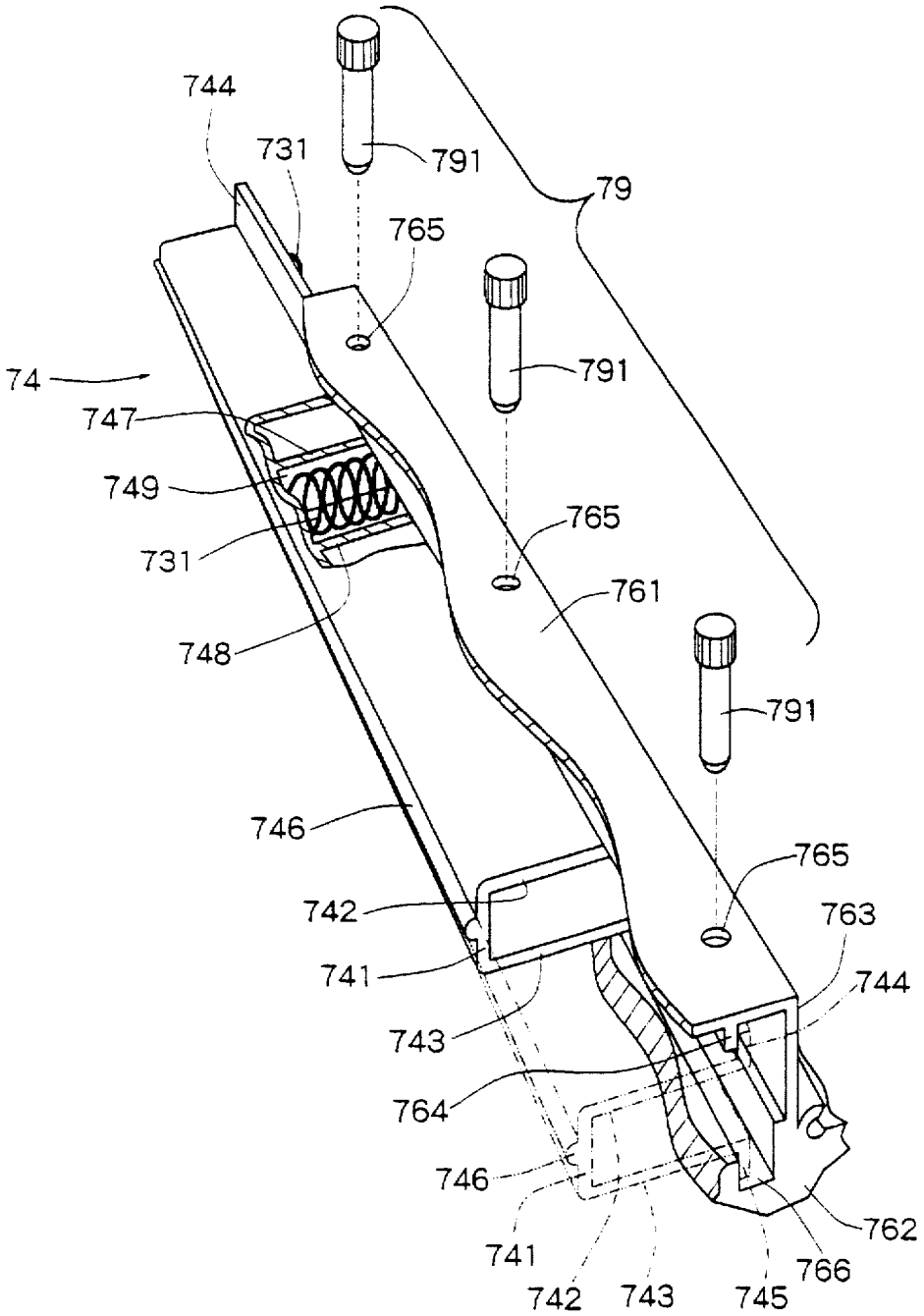
FIG. 7 is a perspective view illustrating, partly in a cut-away manner, major portions of the developing agent-limiting means mounted on the device for developing an electrostatic latent image shown in FIG. 1.
Figure 8:
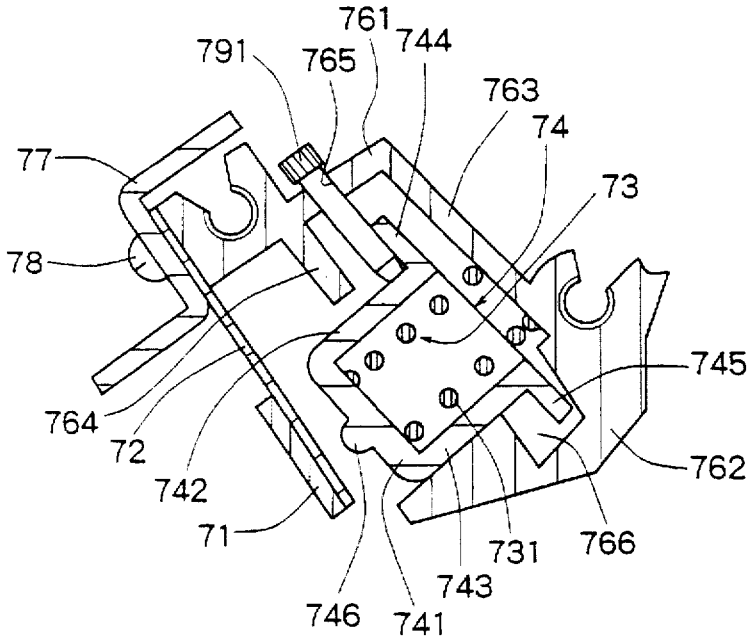
FIG. 8 is a sectional view illustrating an assembly state of the developing agent-limiting means that will be mounted on the device for developing an electrostatic latent image shown in FIG. 1.

The resilient urging means 73 comprises a plurality of compression coil springs 731 (six compression coil springs in the illustrated embodiment). The ends on one side of the compression coil springs are fitted to the plurality of spring fitting chambers formed in the pushing member 74, and the ends on the other side thereof are brought into contact with the front surface of the rear wall 763 which constitutes the support holder 76. Being constituted as described above, the pushing forces of the plurality of compression coil springs 731 arranged at an equal distance in the direction of width of the pushing member 74 act on the blade 71 through the pushing member 74 and the support plate 72, so that one surface of the blade 71 is brought into pressed contact with the surface of the roller 42 that constitutes the developing roller. Here, since the pushing member 74, support plate 72 and blade 71 have flexibility, the one surface of the blade 71 is brought into uniformly pressed contact with the surface of the roller 42 constituting the developing roller 40 over the whole width even though the shaft of the developing roller 40 is deflected to some extent. The support plate 72 fitted to the blade 71 is pushed by a protrusion 746 formed on the front surface of the front wall 741 constituting the pushing member 74, and receives a uniform pushing force stably over the whole width since the contact area of the protrusion 746 to the support plate 72 is small. The pressing force of the blade 71 acting on the peripheral surface of the roller 42 constituting the developing roller 40 can be suitably set depending upon the thickness of the developing agent layer that is to be formed on the peripheral surface of the roller 42. The thickness of the developing agent layer formed on the peripheral surface of the roller 42 decreases with an increase in the pressing force. As the pressing force becomes excessive, on the other hand, smooth rotation of the roller 42 is likely to be impaired. In the developing system of the illustrated embodiment, in general, the toner layer formed on the peripheral surface of the roller 42 is from about 20 to about 35 μm. To suitably form the developing agent layer having such a thickness, the blade 71 should be brought into pressed contact with the peripheral surface of the roller 42 with a line pressure (pressure per a unit length in the direction of width) of from 4.0 to 12.0 g/mm The developing agent-limiting means 70 has a pressure-canceling means 79 for canceling the pressure exerted on the support plate 72 and on the blade 71 by the resilient urging means 73 (see FIG. 7). In the illustrated embodiment, the pressure-canceling means 79 has three stopper pins 791. At the time of assembling the developing agent-limiting means 70, the three stopper pins 791 are inserted, as shown in FIG. 8, in the three pin-insertion holes 765 formed between the rear wall 763 and the guide rail 764 of the upper wall 761 that constitutes the support holder 76, and act on the front surface of the guide support portion 744 that constitutes the pushing member 74 to cancel the pressing force of the resilient urging means 73 acting on the back surface of the support plate 72. After the developing agent-limiting means 70 is assembled on a predetermined portion of the developing device 8, the three stopper pins 791 are removed from the pin-insertion holes 765, so that the pushing forces of the compression coil springs 751 act on the back surface of the support plate 72 as shown in FIG. 1.

Described below is the procedure for assembling the developing agent-limiting means 70. In assembling the developing agent-limiting means 70, an end of the compression coil spring 731 is, first, fitted to the spring-fitting chamber 749 of the pushing member 74 as shown in FIG. 7, and while being compressed, the compression coil spring 731 is inserted from an end o, the support holder 76 toward the other end of the holder 76. At this time, the guide support port-.on 44 of the upper side of the pushing member 74 is located between the rear wall 463 and the guide rail' 764, and the guide support portion 745 on the lower side is located in the guide groove 766, so that the pushing member 74 is inserted in a predetermined position of the support holder 76 to form the resilient urging means 73. When the resilient urging means 73 is mounted on the support holder 76, as described above, the front wall 741 of the pushing member 74 is pushed toward the rear wall 763 against the force of the compression coil springs 731, so that the guide support portion 744 is moved toward the rear wall 763 beyond the pin-insertion holes 765. In this state, stopper pins 79 are inserted in the pin-insertion holes 765, as shown in FIG. 7, whereby the stopper pins 79 act on the front surface of the guide support portion 764 that constitutes the pushing member 74 to limit the forward motion of the pushing member 74, so that the pushing forces of the compression coil springs 731 no longer act on the back surface of the support plate 72. The developing agent-limiting means 70 assembled in a state where the pushing force is canceled is mounted in the developing housing 30 together with the developing roller 40 as a unitary structure.

Described below with reference to FIG. 3 is how to assemble the developing roller 40 and the developing agent-limiting means 70 as a unitary structure. To assemble the developing roller 40 and the developing agent-limiting means 70 as a unitary structure according to the present invention, use is made of two bearing support members 80 and 80. On the bearing support members 80 and 80 are mounted bearings 81 and 81 such as ball bearings for rotatably supporting the rotary shaft 41 of the developing roller 40. Seal-mounting portions 82 and 82 are provided in part of the circumference of the bearings 81 and 81 on the inside surfaces of the bearing support members 80 and 80, i.e., from the downstream side of the developing zone 404 to the upstream side of the developing agent-limiting zone 403. On the seal-mounting portions 82 and 82 are mounted seals 90 and 90 that are arranged so as to be opposed to both ends of the roller 42 that constitutes the developing roller 40. Each of the seals 90 and 90 mounted on the seal-mounting portions 82 and 82 has a seal body 91 and, a seal lip 92 formed on the upper surface of the seal body 91 which is inwardly tilted or oblique with respect to the seal body and which extends from the side of the developing zone 404 toward the side of the developing agent-limiting zone 403. Seals 90 and 90 also have an outer side wall 93 erected at the outer end of the seal body 91. The seal lip 92 is so constituted that a first end thereof provided on the side of the developing agent-limiting zone 403 is positioned on the inside of the inner end surface of the seal body 91. While the opposite end of seal lip 92 (i.e., that end on the side of the developing zone) is positioned further externally on the outer end surface of that end of the seal body on the side of the developing zone. In a state where the rotary shaft 41 of the developing roller 40 is mounted on the bearings 81 and 81, both ends of the roller 42 are so positioned as to slightly compress the seal lips 92 and 92 of the seals 90 and 90. As the developing roller 40 rotates, therefore, the developing agent staying on the seal bodies 91 and 91 on the inside of the seal lips 92 and 92 is inwardly guided by the seal lips 92 and 92 and is conveyed to the side of the developing agent-limiting zone 403. On the upper inner side surfaces of the bearing support members 80 and 80 are provided positioning projections 83 and 83 that serve as positioning means which engage with the positioning notches 722 and 722 formed in the support plate 72. Three screw-insertion holes 84, 85 and 86 are respectively formed in the upper part of the bearing support members 80 and 80, and a threaded hole 87 is formed in the lower part thereof. Three threaded holes 768*a*, 768*b* and 768*c* are formed at both end portions of the support holder 76 that constitutes the developing agent-limiting means 70. In the lower parts of the bearing support members 80 and 80 are formed notched recesses 88 and 88 for preventing the interference with the rotary shaft 51 of the replenishing roller 50 mounted on the developing housing 30 when the unit of the developing agent-limiting means 70 and the devolving roller 40 is mounted in the developing housing 30. On the outer surfaces of the bearings 81 are formed support protrusions 89 and 8~ having a hole in which will be inserted the rotary shaft 41.

Figure 4:
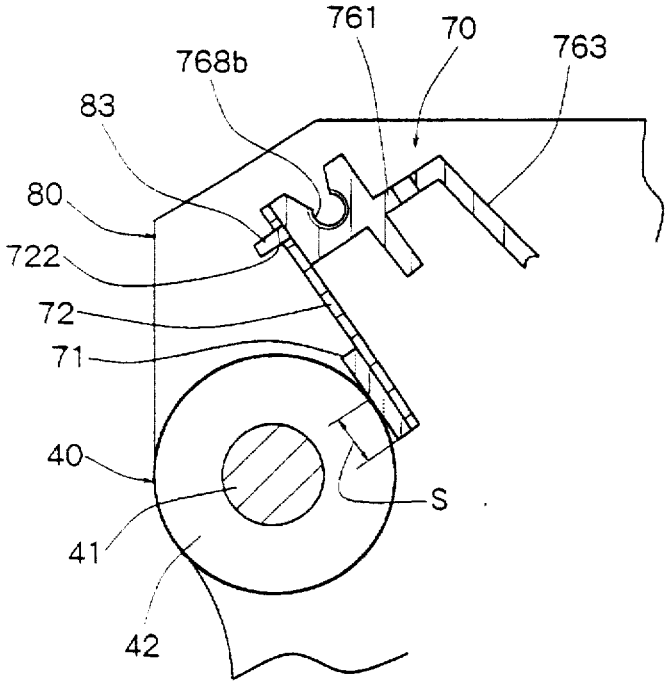
FIG. 4 is an explanation view illustrating, on an enlarged scale, a positional relationship between the developing roller and a blade of the developing agent-limiting means mounted on the device for developing an electrostatic latent image shown in FIG. 1.

After the rotary shaft 41 of the developing roller 40 is inserted in the bearings 81 and 81 of the thus constituted two bearing support members 80 and 80, the support holder 76 of the developing agent-limiting means 70 that is assembled as described above is mounted but excluding the support plate 72 and the blade 71. To mount the support holder 76, the three threaded holes 768*a*, 768*b* and 768*c* formed at both ends of the support holder 76 are positioned opposed to the three screw-insertion holes 84, 85 and 86 formed in the bearing support members 80 and 80, and a screw 841 is inserted in the screw insertion hole 84 from the outer side of the bearing support members 80, 80 and is screwed into the threaded hole 768*a* formed in the support holder 76. Then, as shown in FIG. 4, the positioning notches 722 and 722 formed at both ends of the support plate 72 secured to the other surface of the blade 71 are positioned being brought into engagement with the positioning projections 83 and 83 formed on the bearing support members 80 and 80. Then, as shown in FIG. 1, the upper end of the support plate 72 is secured to the front end surface of the upper wall 761 that constitutes the support holder 76 by using the screw 78 that engages with the threaded hole 767 via the patch 77 and the hole 721. As described above, the developing roller 40 and the developing agent-limiting means 70 are constituted as a unitary structure by being mounted on the two bearing support members 80 and 80. The support plate 72 secured to the other surface of the blade 71 of the developing agent-limiting means 70 that is constituted as a unitary structure together with the developing roller 40, has the positioning notches 722 and 722 formed at both ends thereof and is brought into position upon insertion of positioning projections 83 and 83 formed on the bearing support members 80 and 80 into notches 722 and 722. By controlling the positional relationship between the bearings 81, 81 mounted on the bearing support members 80, 80 and the positioning projections 83, 83 formed on the bearing support members 80, 80, therefore, it is allowed to adjust the amount (S) of projection of the blade 71 from the center of contact relative to the peripheral surface of the developing roller 40 to the lower end thereof. The amount (S) of projection of the blade 71 is set to be, for example, from 0.5 to 2.0 mm. When the amount (S) of projection is smaller than 0.5 mm, the limiting action by the blade 71 becomes so excessive that a good developing agent layer tends to be not formed. When the amount (S) of projection is larger than 2.0 mm, on the other hand, the thickness of the developing layer tends to increase excessively.

Figure 5:
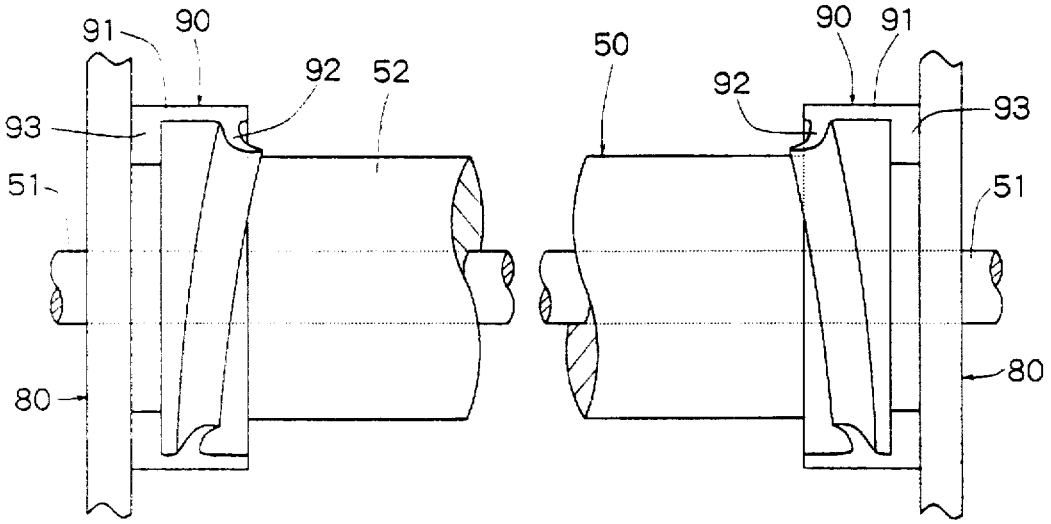
FIG. 5 is a plan view of major portions illustrating, on an enlarged scale, a relationship between a replenishing roller and seals mounted on the device for developing an electrostatic latent image shown in FIG. 1.

The relationship between the seal 90 and the replenishing roller 50 will now be described with reference to FIG. 5. The end surface of the roller 52 constituting the replenishing roller 50 is positioned in contact with the inner end surface of the seal body 91 constituting the seal 90. Therefore, the developing agent is inwardly guided along the inside of the seal lip 92 and is conveyed to the side of the developing agent-limiting zone 402 with the rotation of the developing roller 40, and undergoes, on the way thereof, the action of the end surfaces of the roller 52 that constitutes the replenishing roller 50. Therefore, the developing agent partly adheres on the replenishing roller. The developing agent that starts becoming solid is pulverized Accordingly, the developing agent is prevented from staying at the end of the seal on the side of the developing agent-limiting zone.

Figure 6:
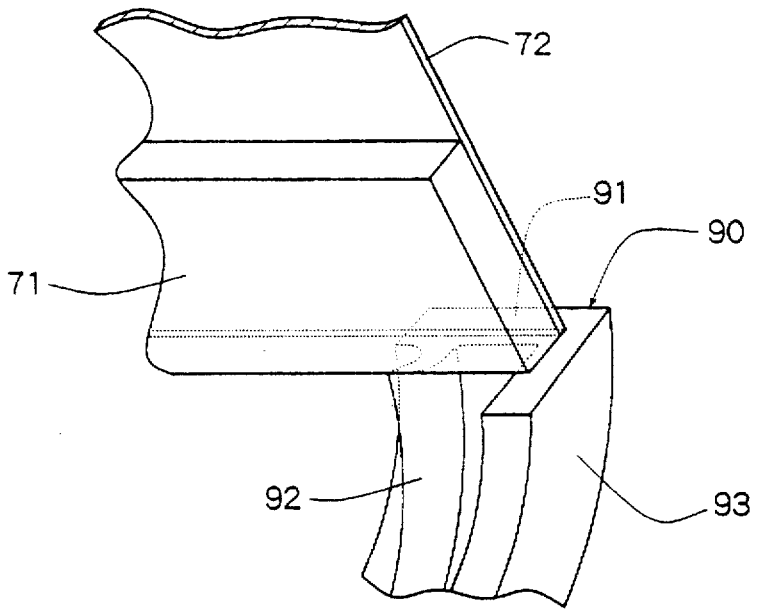
FIG. 6 is a perspective view of major portions illustrating, on an enlarged scale, a relationship between the blade constituting the developing agent-limiting means and the seals mounted on the device for developing an electrostatic latent image shown in FIG. 1.

Next, described below with reference to FIGS. 4 and 6 is a relationship between the blade 71 and the seal 90. The lower end of the blade 71 is positioned in contact with the end surface of the seal 90 on the side of the developing agent-limiting zone 403. The lower end of the blade 71 is also in contact with all end surfaces of the seal body 91, seal lip 92 and outer side wall 93. It is therefore allowed to prevent the developing agent in the developing chamber 35 from infiltrating into space formed by the seal body 91, seal lip 92 and outer side wall 93 from the end on the side of the developing agent-limiting zone 403.

The unit of the thus assembled developing roller 40 and the developing agent-limiting means 70 is mounted on the developing housing 30 from the side of the opening 38 of the developing housing 30. In this case, the support protrusions 89 and 89 formed on the outer surfaces of the bearing support members 80 and 80 are fitted to the notched recesses 321 and 331 formed in both side walls 32 and 33 of the developing housing 30. The rotary shaft 51 of the replenishing roller 50 mounted on the developing housing 30 is loosely fitted to the notched recesses 88 and 88 formed in the bearing support members 80 and 80. Thus, the unit of the developing roller 40, developing agent-limiting means 70 and bearing support members 80 and 80 is mounted on a predetermined position of the developing housing 30. Then, the screws 851 and 861 are inserted in the screw-insertion holes 85 and 86 formed in the bearing support member 80 from the outer sides of the two walls 32 and 33 constituting the developing housing 30, and are screwed ~o the threaded holes 768*b* and 768*c* formed at both ends of the support holder 76 constituting the developing agent-limiting means 70, so that the support holder 76 and the bearing support members 80, 80 are fastened to the side walls 32 and 33 that constitute the developing housing 30. Furthermore, the screws 871 and 871 are screwed to the screw holes 87 and 87 formed in the bearing support members 80 and 80 from the outer sides of the two walls 32 and 33 of the developing housing 30, in order to fasten the bearing support members 80 and 80 to the two side walls 32 and 33 of the developing housing 30. When the unit of the developing roller 40 and the developing agent-limiting means 70 is, as described above, mounted at a predetermined position in the developing housing 30, the stopper pins 79 are removed from the pin-insertion holes 765, whereby the pushing member 74 is permitted to move forward, i.e., toward the support plate 72, and the protrusion 746 formed on the front surface of the pushing member 74 is pushed onto the back surface of the support plate 72 by the compression springs 731. As described above, since the developing agent-limiting means 70 according to the illustrated embodiment is assembled in a state where the pushing force acting on the back surface of the support plate 72 on which the blade 71 is mounted is canceled, the peripheral surface of the developing roller 40 is not damaged by the blade 71 at the time of mounting the developing agent-limiting means 70 in the developing housing 30.

Figure 9:
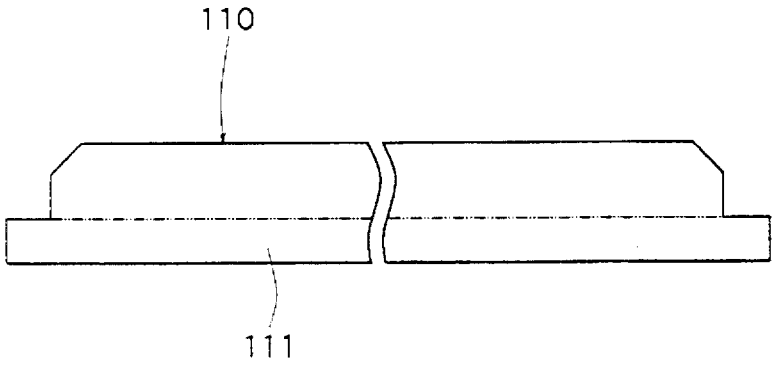
FIG. 9 is a plan view of a sheet-like sealing member mounted on the device for developing an electrostatic latent image shown in FIG. 1.
Figure 10:
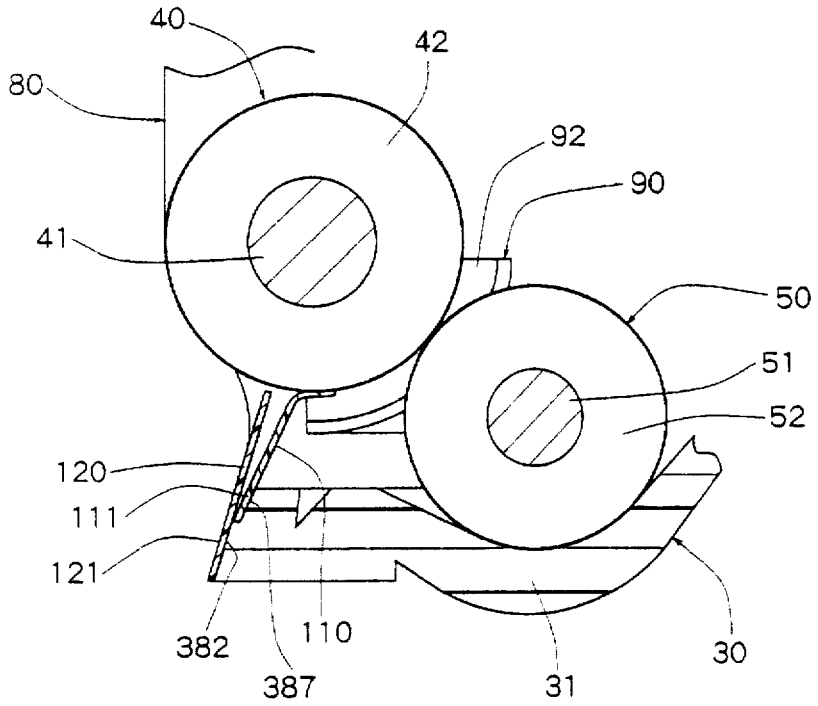
FIG. 10 is an explanation view illustrating, on an enlarged scale, a relationship among the sheet-like sealing member, a sheet-like cover member, the developing roller and the seals mounted on the device for developing an electrostatic latent image shown in FIG. 1.
Figure 11:
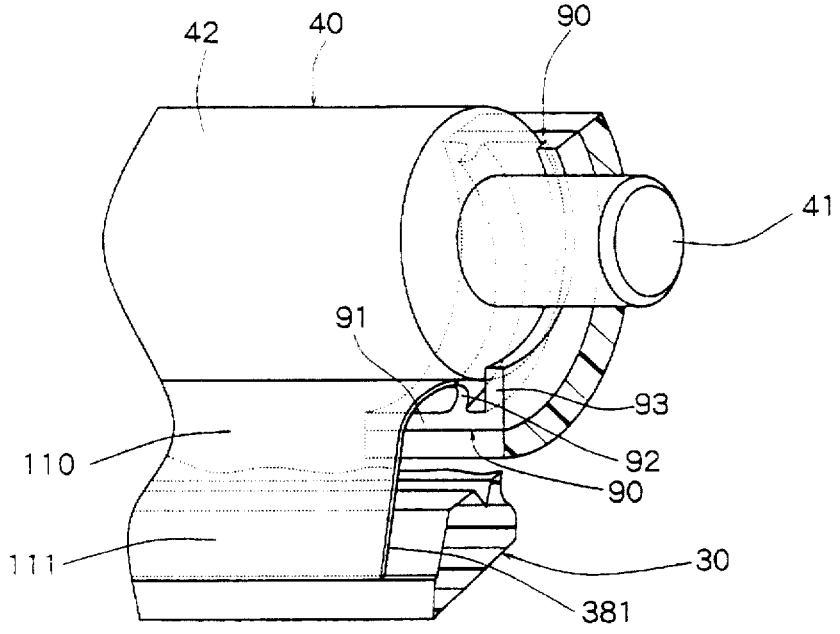
FIG. 11 is a perspective view illustrating, on an enlarged scale, part of a relationship between the sheet-like sealing member and the seals mounted on the device for developing an electrostatic latent image shown in FIG. 1.

In the device for developing an electrostatic latent image according to the illustrated embodiment, a sheet-like sealing member 110 is disposed at an end of the opening 38 on the side of the developing zone in the developing housing 30. The sheet-like sealing member 110 is constituted by a sheet member having elasticity such as polyethylene terephthalate (PETP) resin and has, as shown in FIG. 9, a length in the direction of width which is slightly shorter than the length in the axial direction of the roller 42 which constitutes the developing roller 40. One end of the sheet-like sealing member 110 is formed as a mounting portion 111 which is fastened, by a fastening means such as adhesive, to a seal-mounting portion 381 formed at an end of the opening 38 on the side of the developing zone in the developing housing 30 (see FIGS. 10 and 11). As shown in FIGS. 10 and 11, the sheet-like sealing member 110 mounted at the end of the opening 38 on the side of the developing zone in the developing housing 30 has its other end that is curved and is brought into resilient contact with the peripheral surface of the roller 42 constituting the developing roller 40. Both ends of the sheet-like sealing member 110 are positioned on the seals 90 and 90, and are brought into contact with the inner side surfaces of the seal lips 92 and 92 formed on the seals 90 and 90 as shown in FIG. 11. By the action of the sheet-like sealing member 110, therefore, the developing agent staying on the seal bodies of the seals 90 and 90 is prevented from scattering through the opening 38 on the side of the developing zone in the developing housing 30.

Figure 12:
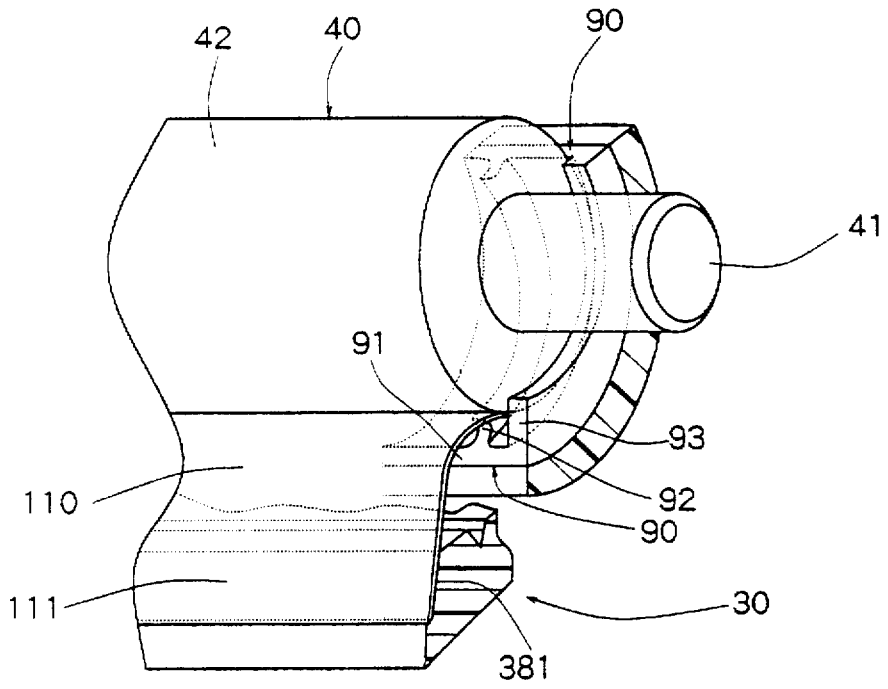
FIG. 12 is a perspective view illustrating, on an enlarged scale, part of a relationship between the sheet-like sealing member according to another embodiment and the seals mounted on the device for developing an electrostatic latent image shown in FIG. 1.

Another embodiment of the sheet-like sealing member 110 will now be described with reference to FIG. 12. The sheet-like sealing member 110 according to this embodiment has a width which is nearly the same as the length in the axial direction of the roller 42 that constitutes the developing roller 40, and has both ends thereof that are positioned on the seal lips 92 and 92 of the seals 90 and 90, as shown in FIG. 12. This makes it possible to reliably prevent the developing agent from scattering from between both ends of the sheet-like sealing member 110 and the inner side surfaces of the seal lips 92 and 92.

Figure 13:
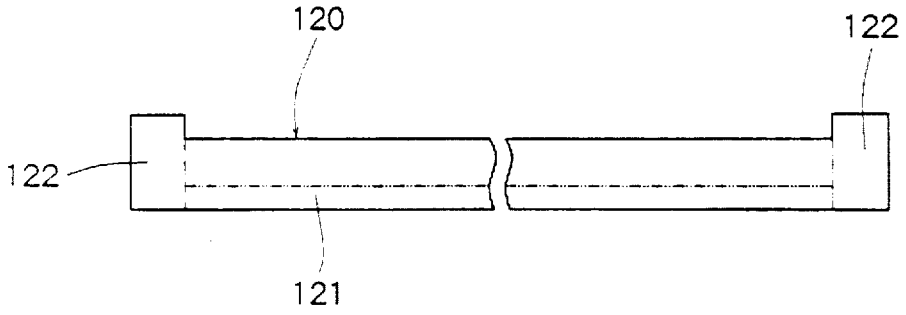
FIG. 13 is a plan view of the sheet-like cover member mounted on the device for developing an electrostatic latent image shown in FIG. 1.
Figure 14:
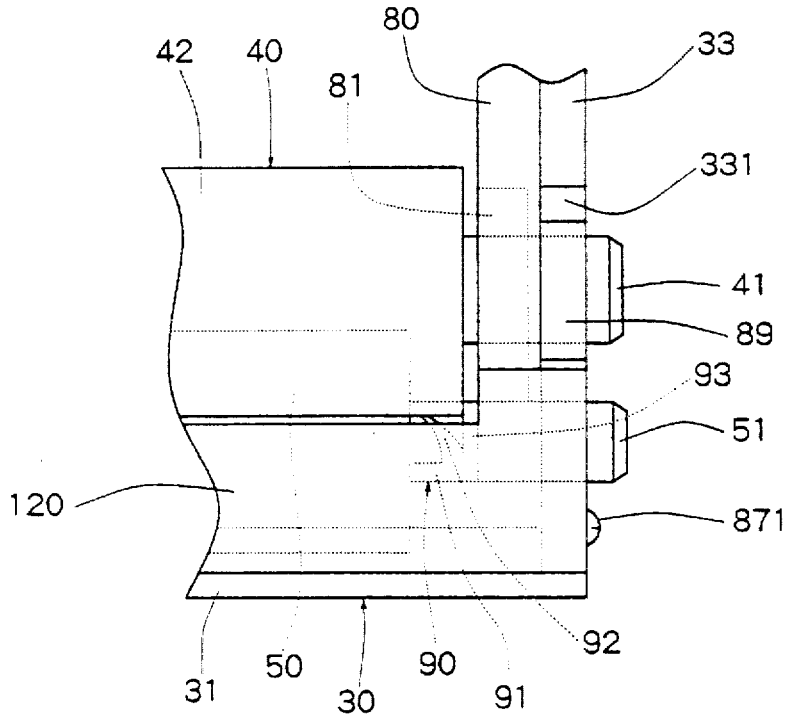
FIG. 14 is a front view illustrating, on an enlarged scale, part of a relationship between the sheet-like cover member and the developing roller mounted on the device for developing an electrostatic latent image shown in FIG. 1.

In the device for developing an electrostatic latent image according to the illustrated embodiment, a sheet-like cover member 120 is disposed at an end of the opening 38 on the side of the developing zone in the developing housing 30. The sheet-like cover member 120 is constituted by a sheet member having elasticity such as polyethylene terephthalate (PETP) resin. As shown in FIG. 13, the sheet-like cover member 120 has mounting portions 121, 122 and 122 formed at one end portion and at both side portions thereof. The width of the sheet-like cover member 120 corresponds to the length between the outer surfaces of both side walls 32 and 32 constituting the developing housing 30, and the length between the mounting portions 122 and 122 formed on both side portions is nearly the same as the length in the axial direction of the roller 42 that constitutes the developing roller 40. As shown in FIGS. 10 and 14, the thus constituted sheet-like cover member 120 has the mounting portion 121 that is fastened, by a fastening means such as adhesive, to an end surface mounting portion 382 on the bottom wall 31 constituting the developing housing 30, and has the mounting portions 122 and 122 that are fastened, by a fastening means such as adhesive, to the end surfaces of both side walls 32 and 33 and to the end surfaces of the bearing support members 80 and 80. As shown in FIG. 14, the sheet-like cover member 120 mounted on the end of the opening 38 on the side of the developing zone of the developing housing 30, has an end that is positioned so as to maintain a small gap relative to the peripheral surface of the roller 42 which constitutes the developing roller 40. Therefore, the developing agent adhered on the peripheral surface of the roller 42 constituting the developing roller 40 is not scraped off. Even when the developing agent adhered on the peripheral surface of the roller 42 constituting the developing roller 40 is scraped off to some extent by the sheetlike sealing member 110 as a result of mounting the sheet-like cover member 120 on the end of the opening on the side of the developing zone in the developing housing 30, the developing agent that is scraped off is confined in space between the sheet-like cover member 120 and the sheet-like sealing member 110, and is prevented from scattering out of the developing housing 30.

The device for developing an electrostatic latent image according to the illustrated embodiment is constituted as described above. Mentioned below is the operation. Upon starting the operation of the device for developing an electrostatic latent image, the roller 42 of the developing roller 40, roller 52 of the replenishing roller 50 and stirring means 60 are rotated in the directions indicated by arrows by a drive means that are not shown. As the stirring means 60 is rotated in the direction indicated by an arrow 601, the developing agent contained in the stirrer chamber 32 is stirred and is fed into the developing chamber 31. Meanwhile, the used developing agent after being held on the peripheral surface of the roller constituting the developing roller 40 and passed through the developing zone 404, is transferred onto the surface of the replenishing roller 50 at a portion where the developing roller 40 and the replenishing roller 50 are in contact with each other, and is mixed in the developing chamber 31 together with the developing agent that is fed by the stirring means 60. The developing agent mixed in the developing chamber 31 is held on the peripheral surface of the roller 52 that is made of a foamed material and constitutes the replenishing roller 50, and is conveyed toward the developing roller 40.

The developing agent held on the peripheral surface of the replenishing roller 50 and conveyed toward the developing roller 40, is supplied to, and is held by, the peripheral surface of the roller 42 constituting the developing roller 40 in the developing agent-holding zone 402, and is conveyed toward the developing agent-limiting zone 403. In the developing agent-limiting zone 403, the blade 71 of the developing agent-limiting means 70 acts on the developing agent held on the peripheral surface of the roller 42 of the developing roller 40, and limits the developing agent held on the peripheral surface of the roller 42 into a predetermined amount to form a thin layer. Here, since the blade 71, support plate 72 and pushing member 74 have flexibility, the one surface of the blade 71 is brought into pressed contact with the surface of the roller 42 of the developing roller 40 uniformly over the whole width even though the shaft of the developing roller 40 may be deflected to some extent.

In the developing zone 404, the developing agent is applied to the electrostatic latent image on electrostatic photosensitive material disposed on the peripheral surface of the rotary drum 2, so that the electrostatic latent image is developed into a toner image. For instance, the electrostatic latent image has a non-imaged region electrically charged to about +600 V and an imaged region electrically charged to about +120 V, and the toner which is the developing agent is adhered to the imaged region (so-called reversal development). The rotary drum 2 is continuously rotated in a direction indicated by an arrow 22 in FIG. 1 and, hence, the peripheral surface of the rotary drum 2 and the peripheral surface of the roller 42 constituting the developing roller 40 move in the same direction in the developing zone 404. The moving speed V2 of the peripheral surface of the roller 42 is set to be slightly larger than the moving speed V1 of the peripheral surface of the rotary drum 2 and it is preferable that a relationship between V1 and V2 is $1.2\ V1 \leqq V2 \geqq 2.2\ V1$. In this case, the developing agent is conveyed in sufficient amounts into the developing zone 404 by the roller 42 of the developing roller 40, the developing agent adhered to the non-imaged portion of the electrostatic latent image is suitably peeled off by the rubbing action of the peripheral surface of the roller 42 with respect to the peripheral surface of the rotary drum 2 and, thus, a good toner image having a suitable developing density and being free from fogging can be obtained. Desirably, the developing agent comprises only a toner having a volume average particle diameter (Vol. 50%: the volume of the toner having sizes smaller than the volume average particle diameter is equal to the volume of the toner having sizes larger than the volume average particle diameter) of from about 8.0 to 12.0 cm and a volume resistivity of not smaller than $10^8$ cm.

As described above, in the device for developing an electrostatic latent image according to the present invention, the seal lips of the seals, which are disposed so as to face both ends of the developing roller, are formed so as to tilt inwardly while also converging from an exterior location on the lip base at an outer end on the side of the developing zone toward a more internal location on the lip base at an inner end on the side of the developing agent-limiting zone. End surfaces of the replenishing roller are also positioned in contact with the inner end surfaces of the seals. Therefore, the developing agent is inwardly guided along the inner side of the seal lips and is conveyed to the side of the developing agent-limiting zone with the rotation of the developing roller, and is acted, on the way thereof, by the end surfaces of the replenishing roller, so that part of the developing agent adheres on the replenishing roller. The developing agent that starts becoming solid is pulverized. Therefore, the developing agent is prevented from staying at the end of the developing agent-limiting zone. Accordingly, the developing agent is prevented from staying at the ends of the seals on the side of the developing agent-limiting zone and is further prevented from adhering as vertical stripes on the peripheral surface of the developing roller.

In the device for developing an electrostatic latent image according to the present invention, furthermore, the lower end of the blade constituting the developing agent-limiting means is positioned in contact with the end surfaces of the seals on the side of the developing agent-limiting zone, the seals having seal lips arranged being opposed to both ends of the developing roller and protruding from the end on the side of the developing zone to the end on the side of the developing agent-limiting zone. Therefore, the developing agent is prevented from entering into space formed on the outside of the seal lips from the end on the side of the developing agent-limiting zone. Accordingly, the developing agent, which is prevented from entering into space formed on the outside of the seal lips, is also prevented from adhering onto the bearings of the developing roller, and from scattering from the end of the side of the developing zone.

In the device for developing an electrostatic latent image according to the present invention, furthermore, provision is made of a sheet-like sealing member made of an elastic material which is so positioned that its one end is fitted into an open end on the side of the developing zone on the bottom wall of the developing housing, its other end is brought into contact with the peripheral surface of the developing roller, and both of its ends (in the direction of width) are brought into contact with the inner side surfaces of the seal lips. By the action of the sheet-like sealing member, therefore, the developing agent staying on the sealing portion is prevented from scattering through the opening of the side of the developing zone in the developing housing.

According to the present invention, furthermore, provision is made of a sheet-like sealing member made of an elastic material which is so positioned that its one end is fitted into an open end on the side of the developing zone on the bottom wall of the developing housing, its other end is brought into contact with the peripheral surface of the developing roller, and both of its ends (in the direction of width) are located on the seal lips. By the action of the sheet-like sealing member, therefore, the developing agent staying on the sealing portion is prevented from scattering through the opening on the side of the developing zone in the developing housing and is further reliably prevented from scattering through between the inner side surfaces of the seal lips and both ends of the sheetlike sealing member.

According to the present invention, there is provided a sheet-like sealing member positioned so that one end is fitted over the open end of the developing housing and its other end is brought into contact with the developing roller, and a sheet-like cover member positioned so that one end is fitted over the open end of the developing housing and its other end is located such that a small gap is maintained relative to the peripheral surface of the developing roller. Even when the developing agent adhered onto the peripheral surface of the developing roller is scraped off to some extent by the sheet-like sealing member, therefore, the developing agent that is scraped off is confined in a space formed between the sheet-like cover member and the sheet-like sealing member and is prevented from scattering out of the developing housing.

What we claim is:

1. A device for developing an electrostatic latent image comprising a developing housing and a developing roller which is disposed in said developing housing and arranged so as to hold developing agent on the peripheral surface thereof in a developing agent-holding zone and to convey the developing agent that is held to a developing zone to apply it to an electrostatic latent image, said device further comprising a feeding roller for feeding the developing agent onto the peripheral surface of said developing roller in the developing agent-holding zone, and seals that are disposed so as to be opposed to both ends of said developing roller from a downstream side of the developing zone to an upstream side of a developing agent-limiting zone, and said seals having seal lips that are formed in a protruding manner from an outer end on the side of the developing zone to an inner end on the side of the developing agent-limiting zone, wherein the seal lips of said seals are formed so as to be tilted from the outer end on the side of the developing zone to the inner end on the side of the developing agent-holding zone, and said feeding roller is so positioned that the end surfaces thereof are in contact with inner end surfaces of said seals.

2. A device as recited in claim 1, wherein said seals each include a seal body having a base from which said seal lips extend, and said seal lips extend along said seal bases so as to have said end on the side of the developing zone further externally positioned, with respect to a direction defined by a rotating axis of said developing roller, than said end on the side of the developing agent-limiting zone, such that developing agent contacting said seals is inwardly guided by said seal lips as the developing agent is conveyed to the side of the developing agent-limiting zone.

3. A device as recited in claim 2, wherein each of said seal lips is tilted with respect to the seal base from which it extends.

4. A device as recited in claim 2, wherein said seals further include an outer side wall joined with said seal base and said seal lips curve away from said outer side wall in extending from said one end to said opposite end of said seal lips.

5. A device as recited in claim 1, wherein each of said seal lips curve inwardly in extending between the end on the side of the developing zone to the end on the side of the developing agent-limiting zone such that developing agent is inwardly guided during conveyance from the developing zone to the developing agent-limiting zone.

6. A device for developing an electrostatic latent image comprising a developing housing, a developing roller which is disposed in said developing housing, holds developing agent on a peripheral surface thereof in a developing agent-holding zone, and conveys the developing agent that is held to a developing zone to apply it to an electrostatic latent image, a developing agent-limiting means for limiting the amount of the developing agent held on the peripheral surface of said developing roller in a developing agent-limiting zone between the developing agent-holding zone and the developing zone, and seals that are disposed being opposed to both ends of the developing roller from the downstream side of the developing zone to the upstream side of the developing agent-limiting zone and having seal lips formed in a protruding manner and which extend from one end on the side of the developing zone to an opposite end on the side of the developing agent-limiting zone, wherein there is provided a sheet-like sealing member made of an elastic material which is so positioned that one end is fitted into an open end of the developing housing on the side of the developing zone, an opposite end of said sheet-like sealing member is brought into contact with a peripheral surface of the developing roller, and both ends of said sheet-like sealing member, in the direction of width, are located on the seal lips, and each of said seals has a seal body from which said seal lip extends, and each seal lip is compressed by said developing roller.

7. A device as recited in claim 6, wherein said seals each include a seal body having a base from which said seal lips extend, and said seal lips extend along said seal bases so as to have said one end on the side of the developing zone further externally positioned, with respect to a direction defined by a rotating axis of said developing roller, than said end on the side of the developing agent-limiting zone, such that developing agent contacting said seals is inwardly guided by said seal lips as the developing agent is conveyed to the side of the developing agent-limiting zone.

8. A device as recited in claim 7, wherein each of said seal lips is tilted.

9. A device as recited in claim 7, wherein said seals further include an outer side wall integrally joined with said seal base and said seal lips curve away from said outer side wall in extending from said one end to said opposite end of said seal lips.

10. A device as recited in claim 6, wherein each of said seal lips curve inwardly in extending between the end on the side of the developing zone to the end on the side of the developing agent-limiting zone such that developing agent is inwardly guided during conveyance from the developing zone to the developing agent-limiting zone.

11. A device for developing an electrostatic latent image comprising a developing housing and a developing roller which is disposed in said developing housing and arranged so as to hold developing agent on the peripheral surface thereof in a developing agent-holding zone and to convey the developing agent that is held to a developing zone to apply it to an electrostatic latent image, said device further comprising a feeding roller for feeding the developing agent onto the peripheral surface of said developing roller in the developing agent-holding zone, and seals that are located from a downstream side of the developing zone to an upstream side of a developing agent-limiting zone of said device, contact the developing roller and the feeding roller, and have seal lips that are tilted.

* * * * *